US005265732A

United States Patent [19]

Long

[11] Patent Number: 5,265,732

[45] Date of Patent: Nov. 30, 1993

[54] VARIABLE BACKGROUND FOR A SORTING MACHINE

[75] Inventor: William C. Long, Houston, Tex.

[73] Assignee: ESM International, Inc., Houston, Tex.

[21] Appl. No.: 7,367

[22] Filed: Jan. 21, 1993

Related U.S. Application Data

[63] Continuation of Ser. No. 703,501, May 21, 1991, abandoned.

[51] Int. Cl.[5] ..... B07C 5/342

[52] U.S. Cl. ..... 209/580

[58] Field of Search ..... 209/580, 581, 582, 587, 209/576, 577; 356/407, 425; 250/226

[56] References Cited

U.S. PATENT DOCUMENTS

| | | | |
|---|---|---|---|
| 3,854,586 | 12/1974 | Perkins | 209/580 |
| 4,074,808 | 2/1978 | Gillespie et al. | 209/587 |
| 4,513,868 | 4/1985 | Culling et al. | 209/587 X |
| 4,624,368 | 11/1986 | Satake | 209/581 |
| 4,625,871 | 12/1986 | Satake | 209/581 X |
| 4,630,736 | 12/1986 | Maughan et al. | 209/587 |
| 4,699,273 | 10/1987 | Suggi-Liverani et al. | 209/587 X |
| 4,734,619 | 3/1988 | Havel | 313/510 |
| 4,811,739 | 3/1989 | Silver . | |
| 4,863,041 | 9/1989 | Bailey | 209/580 |
| 4,878,582 | 11/1989 | Codding | 209/580 |

FOREIGN PATENT DOCUMENTS

| | | |
|---|---|---|
| 0115122 | 8/1984 | European Pat. Off. . |
| 0146299 | 6/1985 | European Pat. Off. . |
| 9006819 | 6/1990 | European Pat. Off. . |

*Primary Examiner*—David H. Bollinger
*Attorney, Agent, or Firm*—Vaden, Eickenroht, Thompson, Boulware & Feather

[57] ABSTRACT

A background for an electro-optical sorting machine viewing station where fungible products pass during the sorting operation and are distinguished by being standard or substandard in one or more spectral ranges comprises a translucent light diffuser or frosted light diffuser and one or more variable intensity lamps for changing the color or hue quality in the spectral ranges. A bichromatic machine is equipped with two lamps, one for each spectral range, preferably orthogonally aligned to each other for beam splitting operation in conjunction with an optical beamsplitter, that separates the longer spectral range wavelengths from the shorter spectral range wavelengths.

5 Claims, 3 Drawing Sheets

VARIABLE BACKGROUND FOR A SORTING MACHINE

This application is a continuation of application Ser. No. 07/703,501, filed May 21, 1991, now abandoned.

BACKGROUND OF THE INVENTION

1. Field of the Invention

This invention pertains to sorting machines that optically sort or separate substandard fungible items from standard items as the items flow past a viewing window of such a machine and in front of a standardized background.

2. Description of the Prior Art

A typical sorting machine of the type with which the present invention is used is a high speed sorting machine typically used for sorting fungible products in the food industry or otherwise. For example, individual coffee beans are caused to flow by gravity feed down a steep channel or chute to be sorted by such a machine to separate "substandard" beans from standard ones. The term "substandard" applies to beans that are outside of a predetermined acceptable range of "color" hue in one or more bands of radiation, which bands are in some cases outside of the visible color spectrum. In the simplest case, the items are sorted for variation from a hue or shade of color, including a shade of black or white and thus a shade of gray, in a single spectrum. Such a sorting procedure is referred to as monochromatic sorting since only a single radiation spectrum is being observed. In a more complex optical color sorting operation, the flow of items is sorted to determine when an item is reflecting an unacceptable radiation amount in either of two radiation bands. Such a sorting procedure is referred to as bichromatic sorting. It will be apparent that more than two radiation bands can be employed, if desired.

Optical sorting machines of the type generally described above employ optical sensors that include one or more photodetectors, such as photodiodes. The photodetectors are positioned to observe the illuminated product stream through a light admitting window. The stream passes between an optical sensor and a background having a color or shade that matches the product stream in standard color or shade so that only a variation in a product color or shade causes a detection event. The illumination is from one or more lamps directed at the product stream to cause standard reflectivity from standard products in the one or more radiation bands being observed and to cause substandard reflectivity from substandard products in those bands.

The machines also include an ejector mechanism located downstream from the sensor or sensors and actuated by an electrical signal originating from sensor detection. When a substandard item or product is detected, an electrical signal is produced and the ejector is actuated just as the substandard product and the mechanism are in alignment. Therefore, there is a very slight delay from the time of sensing to the time of ejecting. The typical ejector mechanism is usually an air ejector.

As mentioned, the product stream flows in front of a background having a color or shade that is critical to the overall operation in that it has to match the standard product under detection in the wavelength or bands being observed by the sensors. This is usually accomplished by carefully painting the background, letting the background dry and then operating the machine or otherwise analyzing whether the color or shade of the background is acceptable. For bichromatic sorting, the background has to be acceptable in reflectivity characteristics in two bands, which is not always easy to tell by a casual observation. Much time is consumed by such a procedure, and such trial-and-error technique still can result in not matching exactly the acceptable radiation ranges as desirably as could be otherwise accomplished by the invention hereafter described. Moreover, when a new selection criterion or criteria is desired, such as for a sort of a different coffee bean from the first sort, the background has to be tediously changed. This change can be by repainting the background or by changing the background to one having the new color or shade that had previously been determined.

Even when a background color is determined in the prior art way just described, a run of a stream of products can cause the background color or shade to change greatly. This is because of paint fading over a period of time, the accumulation of product dust, or the like.

The need for having a dynamically variable background for a sorting machine was recognized and a procedure is disclosed therefor in U.S. Pat. No. 4,863,041, Roger F. Bailey, which patent issued Sep. 5, 1989. The Bailey patent utilizes a plurality of photosensors viewing respectively separate background assemblies. Each background assembly is the end of a bundle of fiber optic fibers. The light into the fibers is controlled typically by two light sources, one source at each of two spectral wavelengths obtained by the use of an appropriate dichroic mirror. Adjustment of the mix of the two light sources is achieved by adjusting the respective voltages on the two sources. Although fiber optic cables are predictable and useful for transmitting light in the visible spectrum, sorting using spectrum ranges in the infrared spectrum is not compatible with fiber optics since such signals fade with fiber optics of varying lengths in a manner that is often unpredictable and not readily controllable. Adjustment to different spectral ranges using the same fiber optics results in fading to different degrees than for the previous ranges, making fiber optics totally unsuited for background determination in such sorting machines.

Therefore, it is a feature of the present invention to provide an improved variable background for sorting machines to allow spectral adjustment in at least one and preferably in two or more spectral ranges, including the infrared ranges.

It is another feature of the present invention to provide an improved variable background for sorting machines employing a frosted glass or the like and one or more adjustable light sources for changing the reflectivity of the background in one or more spectral ranges.

It is still another feature of the present invention to provide an improved variable background for sorting machines including a frosted glass or the like, a beamsplitter and two light sources for changing the reflectivity of the background in two separated spectral ranges.

SUMMARY OF THE INVENTION

The background improvement in accordance with the present invention operates in conjunction with an electro-optical viewing station of a machine for sorting small fungible items in a flow of such products. The basic components of a monochromatic sorting machine of this type includes a product channel for the product stream that includes a viewing station at some location therealong, one or more lamps at the viewing station for reflecting light from the product stream, an optical sensor at the viewing station for sensing a predetermined wavelength of reflected light selected from the available spectral ranges or bands, a comparator connected to each sensor and to a minimum standard (which can be provided by hardware or software means) for determining if the quantity of light reflected in a preselected spectral range is below or above a predetermined level, and an ejector or product separator for separating products from the stream detected by the sensor or sensors as being below or above the predetermined level in light reflectivity in any of the operating spectral bands.

The aforementioned background in accordance with the invention for a monochromatic sorting machine includes a frosted glass and a light shining thereon, usually from the back, that can be preset or selectively adjustable in intensity for establishing a background with color and a reflectivity bandwidth matching that of acceptable products in the product stream. Selective adjustability can be provided by a suitable dimmer control or current limiter connected to the background light.

The background in accordance with the invention for a bichromatic sorting machine includes a frosted glass and a first and second light shining thereon, usually from the back, one light producing primarily long wavelength radiation for a first inspection spectral range and the other light producing primarily short wavelength radiation for a second inspection spectral range. These two background lights can be independently adjustable by filtering and/or by suitable dimmer controls or current limiters connected to the respective background lights. Preferably, the lights are positioned to be orthogonal to each other and have their reflected lighting emissions respectively filtered by or reflected by a bichromatic beamsplitter so that the proper mix of long wavelength color and reflectivity characteristics in the first inspection spectral range can be established independently of the desired short wavelength color and reflectivity characteristics.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiments thereof which are illustrated in the drawings, which form a part of this specification. It is to be noted, however, that the appended drawings illustrate only typical preferred embodiments of the invention and are not to be considered limiting of its scope as the invention may admit to other equally effective embodiments.

IN THE DRAWINGS

Figure 1:
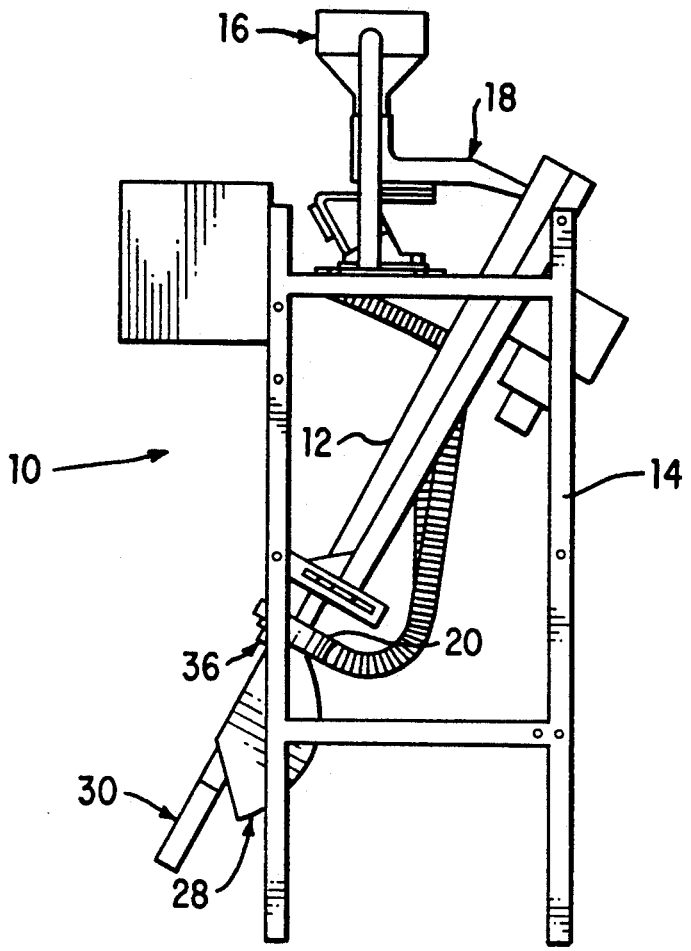

FIG. 1 is a side view of an electro-optical sorting machine incorporating a background requirement in accordance with the present invention.

Figure 2:
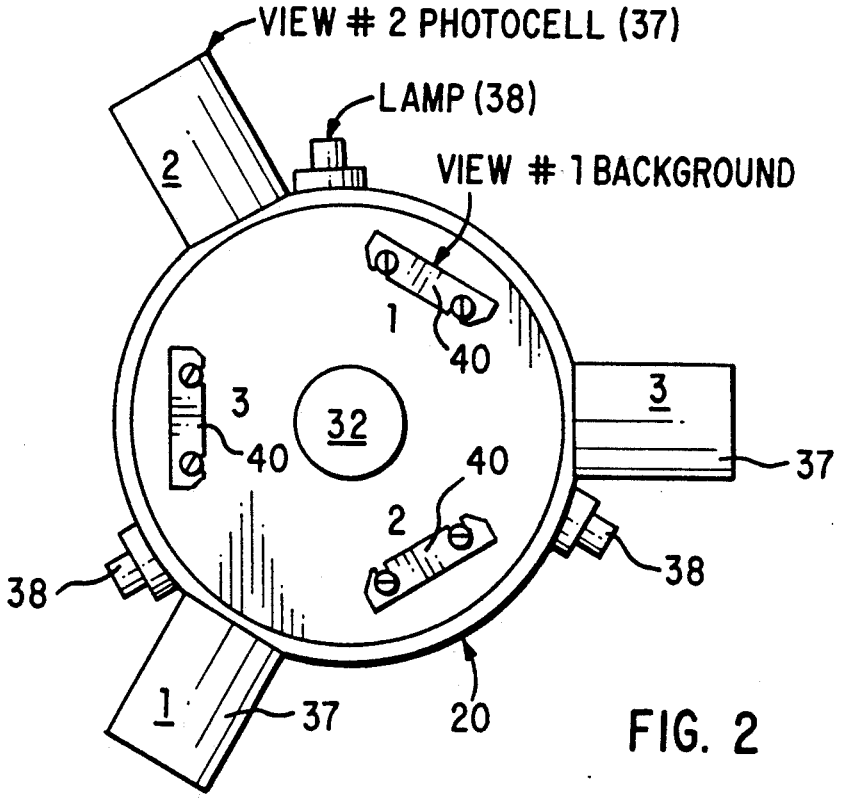

FIG. 2 is a top view of an optical viewing station of an electro-optical sorting machine, such as shown in FIG. 1.

Figure 3:
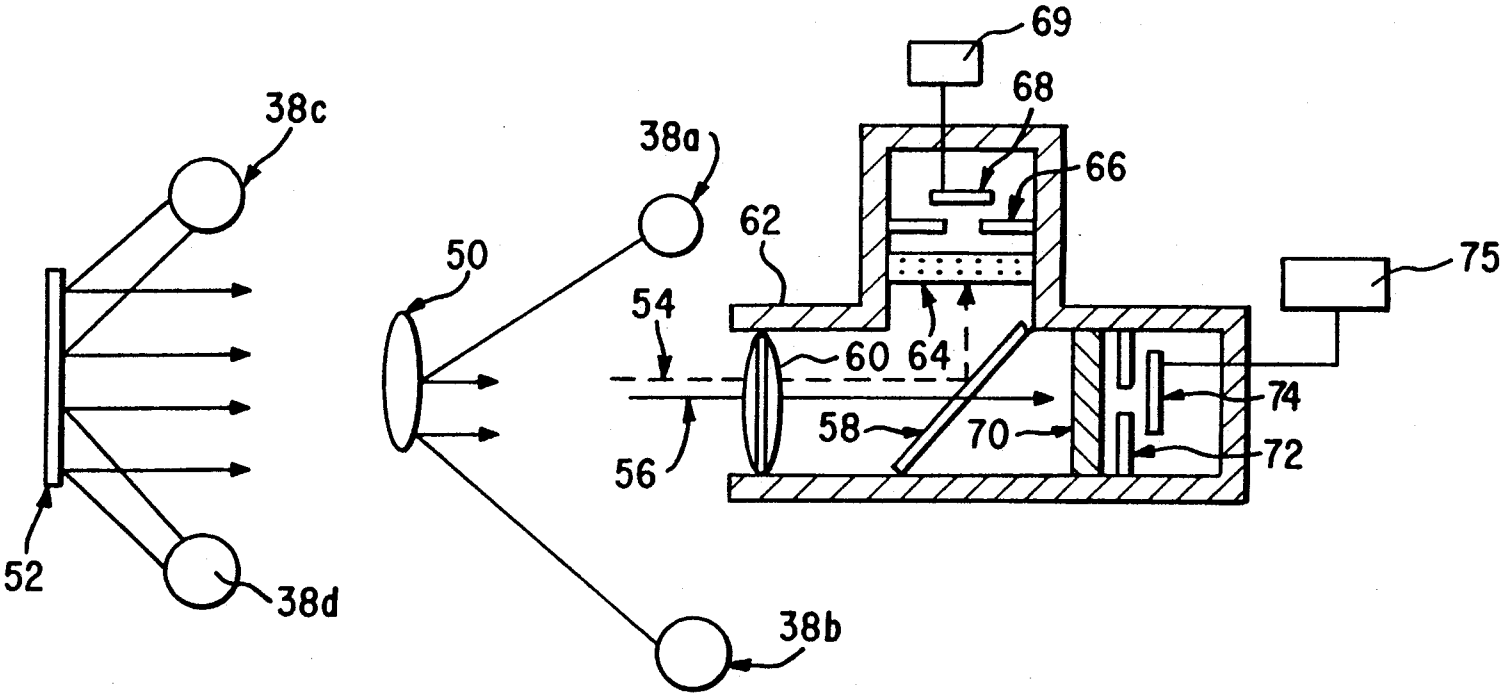
FIG. 3 PRIOR ART

FIG. 3 is a diagrammatic illustration of a bichromatic optical viewing station of a sorting machine in accordance with the prior art, which is also applicable except for the background, in accordance with a bichromatic machine as set forth herein.

Figure 4:
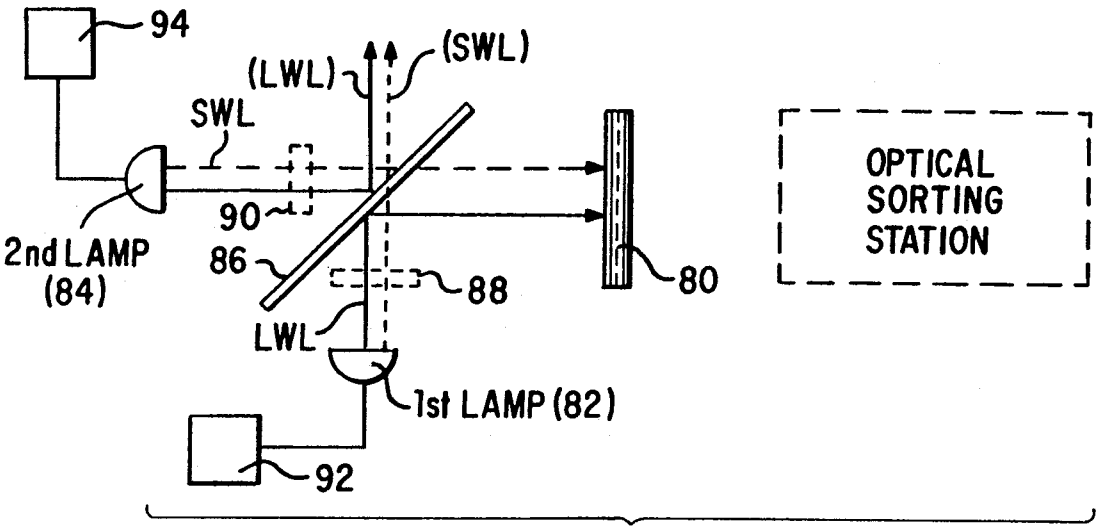

FIG. 4 is a diagrammatic illustration of a preferred first embodiment of a background arrangement in accordance with the present invention.

Figure 5:
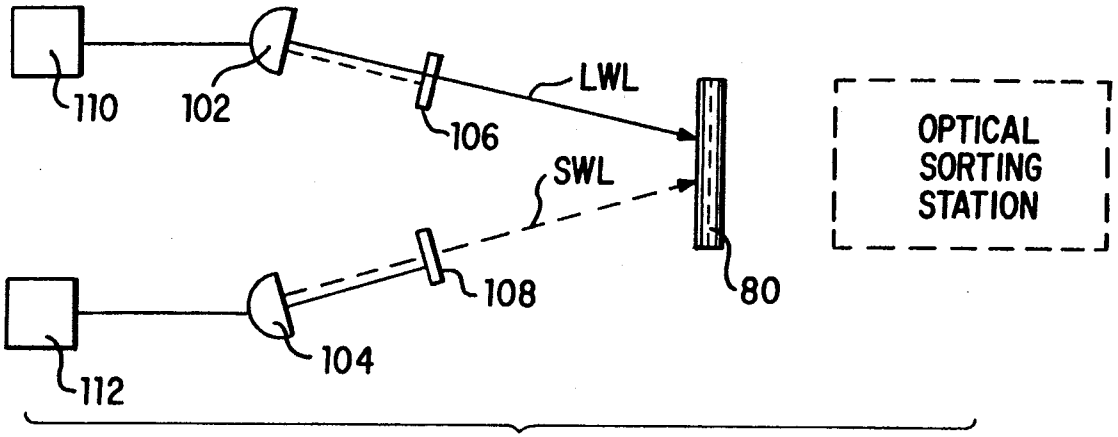

FIG. 5 is a diagrammatic illustration of a second embodiment of a background arrangement in accordance with the present invention.

DESCRIPTION OF THE PREFERRED EMBODIMENTS

Now referring to the drawings, and first to FIG. 1, a high speed sorter for separating nonstandard fungible products or items from a passing stream or flow of such products is shown. Generally, machine 10 includes one or more channels or chutes or slides 12 at a steep angle, usually over 45° and preferably nearly vertical on the order of 80°. The channels are held in position by a framework 14 and are gravity fed the product to be sorted at the top by a hopper 16 attached to the same framework. The product feeds from hopper 16 through dividing vibratory feeder 18 to channels 12. Although a commercial machine usually has two or more channels 12 operating simultaneously with respect to the product that flow respectively through them, for simplicity of discussion, machine 10 is discussed hereinafter as including only a single channel 12.

The products to be separated or sorted by machine 10 are small fungible items, such as coffee beans. Coffee beans, it will be appreciated, are individually identifiable by color in one or more spectral bands. The feed from the hopper via the vibratory feeder and down the channel is all by gravity action. The flow of the products is only slowed from free fall by the friction caused by the bends and the surfaces of the path. The products do move, however, at a fast rate and in large quantity, as is well known in the art.

An optical viewer or sensor 20, described more fully below, is located toward the bottom part of the channel. As the flow of products passes past the sensor, any nonstandard or substandard products are sensed or detected. It will be appreciated that such sensing or detection requires the substandard products to be distinguished both from the standard products and the background. Typically, a substandard item, such as a coffee bean, is detectable on the basis of its being darker or lighter or of a different color or hue from an acceptable range of darkness, lightness or color predetermined for standard or acceptable items. This sensing can be in a single spectral range for monochromatic detection, in two separated spectral ranges for bichromatic detection, or in a plurality of spectral ranges for multichromatic detection. It is understood that a "spectral range" can be wholly or partially in the visual spectrum or can be wholly or partially in the nonvisual spectrum. For example, sensing in the infrared range is commonly done. When a substandard product or item is sensed, an electrical signal is produced that results in an ejection of the substandard item by the actuation of an ejector mechanism.

An ejector 36 located underneath and adjacent optical sensor means 20 is actuated by the actuation electrical signal just mentioned to produce an air blast to remove the unwanted substandard product from the flow of products in the product stream. The ejector can be a mechanical ejector, if desired. When the actuation signal occurs, typically, a solenoid valve is operated to release or emit an air blast at the product stream to timely remove the substandard item. The delay in actuation is very short following the time of sensing, the timing being such to produce the desired expelling of the detected substandard item and is accomplished in a manner well known in the art. The items thus removed in the process fall down into reject accumulator 28 for subsequent disposal. The items not removed continue down channel extension 30 to be gathered or packaged as quality products passing the preset standards and avoiding removal. The control of the flow and the sensitivity of the sensors are controlled by preset controls that are well-known in the art.

Now referring to FIG. 2, the viewing or optical sensor and related components of the machine are illustrated as seen from above. Sensor means 20 generally is a ring-like structure with a center opening 32, the flow of the products to be separated or sorted as discussed above passing through the opening at a "window" location or plane. This is the electro-optical viewing station for the machine. The optical or viewing mechanism is well-known and generally includes three evenly, peripherally spaced individual sensors 37, which could include a photocell or photodiode. At least three lamps 38 are included in the plane, one for each individual sensor. Each lamp 38 projects a beam against a separate background plate 40, the reflection therefrom and from any products flowing between the background plate and the photocell sensor being detected by the sensor. The reason that three sensors are employed is to ensure sensing a substandard item that is detectable from only one direction and not necessarily from another direction. Only one lamp 38 is shown for each viewing combination of photocell sensor 37 and background plate 40. In actual practice, there are usually multiple lamps 38 for illuminating the product stream uniformly and the same or additional multiple lamps for illuminating the background plate uniformly.

A typical prior art bichromatic sensing arrangement where the product stream is viewed in two spectral bands or ranges is shown in FIG. 3. Product 50 in the product stream is illuminated by product lamps 38*a* and 38*b* and painted background 52 is illuminated by background lamps 38*c* and 38*d*. The reflected light spectrum includes longer wavelengths of light 54 in a first spectral range and shorter wavelengths of light 56 in a second spectral range. The first and second spectral ranges are preselected or predetermined as being significant for the product being sorted. If the product reflects less than a predetermined amount of light in either spectral range, then the product is substandard and will be rejected, as discussed previously.

Beamsplitter 58 is established at 45° with respect to the paths of reflected light 54 and 56 as focused by lens 60 located across the entrance of sensor housing 62. The longer wavelengths are reflected by the beamsplitter and are filtered by long wavelength narrow band filter 64. Longer wavelengths of light do not pass through the beamsplitter and short wavelengths are not reflected by the beamsplitter. Optical stop 66 located behind filter 64 includes a small opening for viewing by photocell 68 tuned to detect long wavelengths in the narrow spectral band permitted by filter 64. Photocell 68 is connected to a detector 69 that generally includes a comparator for determining if the predetermined minimum standard level of reflected light is present in the predetermined longer wavelength spectral range with respect to a standard level furnished by accompanying hardware and/or software.

In a similar fashion, the shorter wave wavelengths are passed through the beamsplitter and are filtered by short wavelength narrow band filter 70. Short wavelengths of light do not reflect from the beamsplitter and long wavelengths of light do not pass through the beamsplitter. Optical stop 72 located behind filter 70 includes a small opening for viewing by photocell 74 tuned to detect short wavelengths in the narrow spectral band permitted by filter 70. Photocell 74 is connected to a detector 75 that generally includes a comparator for determining if the predetermined minimum standard level of reflected light is present in the predetermined shorter wavelength spectral range with respect to a standard level furnished by accompanying hardware and/or software.

A monochromatic machine would not include a beamsplitter but would include a filter or filters for assuring that the product reflections in the spectral range of interest are focused on the photocell for detection purposes.

Now referring to FIG. 4, a first embodiment of the variable background apparatus in accordance with the present invention is illustrated. A frosted glass 80 plate or panel is shown for diffusing light reflected thereon, while permitting light or color to be observed from its opposite side. The glass thickness and method of frosting is of relatively little importance for accomplishing this function and techniques for frosting glass are well known in the art. Such techniques include etching or the inclusion of a translucent plastic layer either sandwiched in the glass or applied to the glass. Other materials such as plexiglass or other plastic can also be employed in the place of glass altogether provided the selected material is sufficiently translucent and sufficiently diffuses light so that as a background surface the light or color is generally uniform over a viewing "window" as that term has been used herein with respect to a sorting machine. "Glass" or "frosted glass" refers herein to any suitable background material or combination of materials suitable for functioning in the manner just described.

A first lamp 82 and a second lamp 84 are positioned orthogonally with respect to each other on the backside of glass 80. Lamp 82 radiates or emits light that includes the long wavelength spectral range preselected for sorting purposes, as hereinbefore discussed. Lamp 82 may also emit light in a shorter wavelength spectrum, which will not be used for establishing the overall background color or shade. In like manner, lamp 84 radiates or emits light that includes the short wavelength spectral range preselected for sorting purposes, as hereinbefore discussed. Lamp 84 may also emit light in a longer wavelength spectrum, which will not be used for establishing the overall background color or shade.

Lamps 82 and 84 are directed at a beamsplitter 86, which is well known in the art as having different band pass and band reflective properties. The beamsplitter is effectively aligned at a 45° angle between the two lamps. As will be seen from the illustration, the long wavelength range from first lamp 92 is reflected from the beamsplitter surface and directed to be received by glass 80. The short wavelengths below the long wavelength spectrum is passed through beamsplitter 86. Although the beamsplitter effectively filters the shorter wavelengths from the longer ones in a manner that might be totally acceptable for spectral content background determination, an additional filter or filters 88 can be included in the emission path between lamp 82 and beamsplitter 86 for passing only the preselected long wavelengths of the spectral range used for sorting purposes.

The short wavelength spectral range predetermined for sorting purposes is passed through the beamsplitter from the second lamp. Longer wavelengths are reflected therefrom. As with the first lamp 84, a suitable filter or filters 90 can be positioned in the emission path from lamp 84 to further specifically select the short wavelength spectral band used for sorting purposes.

The intensity or brightness or spectral content of the long wavelength spectral range is determined by variable control 92 connected to lamp 82, which control is usually a current supply control. In like manner, the intensity or brightness or spectral content of the short wavelength spectral range is determined by variable control 94 connected to lamp 84, which control is usually a current supply control. By mixing the intensities of lamps 82 and 84 by respective controls 92 and 94, the overall spectral content of the background color or shade is established on background glass 80. Background glass 80 is positioned as any of background plates 40 in the optical sorting station shown in FIG. 2 or in place of painted background 52 shown in FIG. 3.

It will be understood that a change of background color or spectral range content is readily accomplished by merely changing controls 92 and 94.

Now referring to FIG. 5, an alternate embodiment to that shown in FIG. 4 is shown. Glass 80 has the diffusion qualities previously described and is located as a background in an optical sorting station in the same manner as glass 80 employed in the embodiment described for FIG. 4. In this case, first lamp 102 and second lamp 104 are positioned at a slightly obtuse angle with respect to the plane of glass 80 so as to emit their respective beams of light to glass 80 at an acute angle with respect to the other's beam. Lamp 102 emits a beam of light that is rich in the long wavelength spectral range, although also possibly including short wavelengths, as well. Filter or filters 106 effectively is a band pass filter for passing the preselected long wavelength spectral band from lamp 102 to glass 80 while filtering out the short wavelengths outside of the desirable long wavelength operating range.

Lamp 104 emits a beam of light that is rich in the short wavelength spectral range, although also possibly including long wavelengths, as well. Filter or filters 108 effectively is a band pass filter for passing the preselected short wavelength spectral band from lamp 104 to glass 80 while filtering out the long wavelengths outside of the desirable short wavelength operating range.

Variable control 110 in the form of a variable current source or the like to lamp 102 provides the means for varying the intensity or brightness or spectral content of the beam from lamp 102 in the preselected long wavelength spectrum. Variable control 112 in the form of a variable current source or the like to lamp 104 provides the means for varying the intensity or brightness or spectral content of the beam from lamp 104 in the preselected short wavelength spectrum.

While two embodiments have been described and illustrated it will be understood that the invention is not limited thereto, since many modifications may be made and will become apparent to those skilled in the art. For example, although variable controls 92, 94, 110 and 112 have been described as simple controls, in practice such controls could include the necessary hardware and/or software for programming or otherwise automatically establishing the control level to the desirable setting, as hereinbefore discussed.

Also, FIGS. 4 and 5 disclose bichromatic backgrounds. A monochromatic background would include only a single lamp or light emitting light in the predetermined wavelength spectrum of interest for sorting purposes. No beamsplitter would be included. An intensity control wold be provided for controlling the light content of the established background in the preselected spectral range. Such control would be most commonly a variable current control to the single lamp.

What is claimed is:

1. In a sorting machine for color sorting a stream of fungible products, selected from a group of products, each group differing from the other in wavelength sorting requirements, passing an electro-optical viewing station into acceptable products of predetermined acceptable color and reflectivity range and non-acceptable products of a color or reflectivity outside of the predetermined acceptable color and reflectivity range which comprises a background for the electro-optical viewing station of the same acceptable color and reflectivity as the average of the acceptable color and reflectivity range for the acceptable products, lamp means for reflecting light from the product stream in at least one wavelength band, an optical sensor for sensing the quantity of light present in the one wavelength band as the stream of products pass by the viewing station, a comparator connected to the optical sensor and to a predetermined minimum standard level for determining if the quantity of light present is above the predetermined minimum standard level, and a product separator for separating products, from the stream of products, that reflect light in one wavelength band below the predetermined minimum standard level, the improvement in said background, which comprises a translucent light diffuser, and at least one light means, for transmitting a broad band spectrum of light to said light diffuser, selectively adjustable in intensity for selectably establishing a background with color and reflectivity characteristics, at a particular wavelength band, matching that of an acceptable product from the selected product stream.

2. In a bichromatic sorting machine for color sorting a stream of fungible products, selected from a group of products, each group differing from the other in wavelength sorting requirements, passing an electro-optical viewing station into acceptable products of predetermined acceptable color and reflectivity range and non-acceptable products of a color or reflectivity outside of the predetermined acceptable color and reflectivity range which comprises a background for the electro-optical viewing station of the same acceptable color and reflectivity as the average of the acceptable color and reflectivity in a short wavelength range and in a long wavelength range for the acceptable products, lamp means for reflecting light from the product stream in the short wavelength range and in the long wavelength range, first and second optical sensors for respectively sensing the quantity of light present in the short wavelength range band and in the long wavelength range band as the stream of products pass by the viewing station, a comparator connected to each of the optical sensors and to a respective predetermined minimum standard level for determining if the quantity of light present in the respective short wavelength range band and long wavelength range band is above the respective predetermined minimum standard level, and a product separator for separating products, from the stream of products, that reflect light in the respective short wavelength range band and long wavelength range band below either of the respective predetermined minimum standard levels, the improvement in said background, which comprises a translucent light diffuser, and at least two light means, at least one of said light means producing a broad band spectrum of light and including broad band filter means for transmitting a broad band spectrum of light to said light diffuser, respectively selectively adjustable in intensity for selectably establishing a background with color and reflectivity in short wavelength and long wavelength characteristics matching that of an acceptable product from the selected product stream.

3. The background improvement in accordance with claim 2, wherein said at least two light means includes a first light for producing a broad band of primarily long wavelength light, first current control means connected to said first light for varying the intensity of the broad band of long wavelength light by varying the current to said first light, a second light for producing a broad band of primarily short wavelength light, and second current control means connected to said second light for varying the intensity of the broad band of short wavelength light by varying the current to said second light.

4. The background improvement in accordance with claim 3, and including a first filter associated with said first light for passing the broad band of primarily long wavelengths and filtering out any broad band primarily short wavelengths, and a second filter associated with said second light for passing any broad band primarily short wavelengths and filtering out the broad band primarily long wavelengths.

5. The background improvement in accordance with claim 3, wherein said first and second lights are aligned orthagonal to each other so that the radiation from one of said first and second lights is directed normally to the plane of said light diffuser and the radiation from the other of said first and second lights is directed parallel to the plane of said light diffuser, and including a beamsplitter for allowing one of the broad band primarily short wavelength and the broad band primarily long wavelength spectral ranges to pass through while deflecting the other of the primarily short wavelength and the primarily long wavelength spectra ranges, said beamsplitter directing the broad band primarily long wavelength radiation from said first light and the broad band primarily short wavelength radiation from said second light to said light diffuser while deflecting the broad band primarily short wavelength radiation from said first light and the broad band primarily long wavelength radiation from said second light.

* * * * *